US005687909A

United States Patent [19]

Dean

[11] Patent Number: 5,687,909

[45] Date of Patent: Nov. 18, 1997

[54] APPARATUS FOR SECURING A LAWN SPRINKLER

[76] Inventor: Porter F. Dean, 23 Cove St., Round Mountain, Nev. 89045

[21] Appl. No.: 530,638

[22] Filed: Sep. 20, 1995

[51] Int. Cl.[6] ..... B05B 15/00

[52] U.S. Cl. ..... 239/276

[58] Field of Search ..... 239/275, 276, 239/230, 233

[56] References Cited

U.S. PATENT DOCUMENTS

| | | | |
|---|---|---|---|
| 3,047,238 | 7/1962 | Sacco | 239/275 |
| 3,994,441 | 11/1976 | Testa | 239/276 |
| 4,256,262 | 3/1981 | Rosenberg et al. | 239/276 |
| 4,801,089 | 1/1989 | Zeman | 239/276 |
| 4,944,476 | 7/1990 | Olson | 239/276 X |

OTHER PUBLICATIONS

H.B. Sherman sprinkler on metal spike (unknown manufacturer).

Water–Whiz 13535 low gallonage, full or part circle, sprinkler on metal T–spike, made by Lego Irrigation, 11700 NW 101st Rd., Medley, Florida.

*Primary Examiner*—Kevin P. Shaver
*Assistant Examiner*—Steven J. Ganey
*Attorney, Agent, or Firm*—Trask, Britt & Rossa

[57] ABSTRACT

The present invention is a lawn sprinkler securing apparatus comprising a spike with an extension attached substantially perpendicularly to the side of the spike. A coupling is attached to the end of the offset which is opposite the end attached to the spike. The coupling has an opening which is designed to receive and hold upright a commercially available sprinkler head. The coupling also has a hose attachment for receiving a standard garden hose for conducting fluid from a hose attached to the hose attachment through a passage in the coupling to the sprinkler head. The offset configuration of the present invention allows a user to impart substantial force in driving the spike into the ground, either by hand, by foot, or with a tool such as a hammer, virtually without the possibility of damaging the sprinkler head. With the ability to use substantial force in driving the spike, the sprinkler can be adequately driven into very hard or rocky soil with all of the force applied substantially axially to the spike itself, such that no torque arms are created which could break or bend the spike.

37 Claims, 6 Drawing Sheets

APPARATUS FOR SECURING A LAWN SPRINKLER

FIELD OF THE INVENTION

The present invention relates generally to an apparatus for securing a lawn sprinkler, and more particularly to a novel offset sprinkler spike configuration for securing the sprinkler.

BACKGROUND OF THE INVENTION

Lawn sprinklers and means for securing or stabilizing these lawn sprinklers are well known in the art. Referring to prior art FIG. 1, a typical lawn sprinkler 10 comprises a tapered shaft 12 and a sprinkler head 14 which are both connected to a hollow coupler 16 which receives a standard garden hose in a threaded connector 18. The hollow coupler 16 communicates water from the garden hose to the sprinkler head 14. This type of lawn sprinkler 10 is generally positioned in a lawn by gripping the sprinkler head 14 and pushing downward, such that the tapered shaft 12 is inserted into the ground. In use, these lawn sprinklers can only be easily inserted into a lawn with deep, loose soil. However, a vast majority of lawns have rocky or hard (e.g. high clay content) soil conditions. These soil conditions make it very difficult to insert the sprinkler 10 into the lawn, since an adequate mount of force cannot be brought to bear on the sprinkler 10.

If the lawn sprinkler 10 is not adequately inserted (e.g. only a couple inches of the tapered shaft inserted into the lawn), the high water pressure and circular movement of the sprinkler head 14 will loosen the portion of the tapered shaft 12 in the lawn, particularly as the soil becomes wet around the tapered shaft 12. Ultimately, the tapered shaft 12 works loose and the sprinkler 10 topples over which results in either the sprinkler head 14 streaming water in one direction into the air or hydraulically digging a trench in the lawn.

Another known design, shown in FIG. 2, attempts to overcome the insertion problem. The lawn sprinkler 20 comprises a tapered shaft 22 and a sprinkler head 24 both connected to a hollow coupler 26 which receives a standard garden hose in a threaded connector 28. The hollow coupler 26 communicates water from the garden hose to the sprinkler head 24. The sprinkler 20 also includes a foot platform 30 extending substantially perpendicular from the tapered shaft 22 with an adequate amount of support webbing 32 between the foot platform 30 and the tapered shaft 22. The lawn sprinkler 20 is inserted by stepping down on the foot platform 30 which assumedly pushes the tapered shaft 22 into the lawn. However, when any substantial obstacle is encountered by the tapered shaft 22, a torque arm is created by the foot platform 30 which either bends or breaks the tapered shaft 22.

Therefore, it would be advantageous to design an apparatus for securing a lawn sprinkler which can be conveniently inserted into and removed from any type of lawn condition.

SUMMARY OF THE INVENTION

The present invention eliminates the problems encountered in present sprinkler securing devices by a novel offset spike configuration.

The present invention is a lawn sprinkler securing apparatus comprising a spike with a spike head at one end and a spike shaft which tapers from the spike head to a tip. The spike shaft can have any suitable cross-sectional shape, such as circular, T-shaped, cross-shaped, triangular, square, rectangular, oval, etc. The spike has an offset or extension attached to the side of the spike near the spike head. The offset extends substantially perpendicularly from the spike shaft. A hollow coupling or conduit is attached to an end of the offset which is opposite the end attached to the spike. The hollow coupling has an opening which is designed to receive a commercially available sprinkler head. The opening is placed on the hollow coupling such that the opening faces in the same direction as the spike head. Thus, when the sprinkler head is attached to the hollow coupling, the sprinkler head will have a plane of rotation which is substantially perpendicular to the lengthwise axis of the spike.

The hollow coupling also has a hose attachment which is preferably a male or female fitting for receiving a standard garden hose. Thus, the hollow coupling acts as a conduit for the flow of fluid from a hose attached to the hose attachment to the sprinkler head. The hollow coupling may have at least one other hose attachment so that a number of lawn sprinklers can be linked in series by additional hoses.

This offset configuration eliminates the problems associated with present lawn sprinklers. Having the spike portion offset from sprinkler head portion of the sprinkler allows a user to impart substantial force in driving the spike into the ground, either by hand, by foot, or with a tool such as a hammer, virtually without the possibility of damaging the sprinkler head. With the ability to use substantial force in driving the spike, the sprinkler can be adequately driven into very hard or rocky soil. Furthermore, all of the force apply is directly to the spike itself, thus no torque arms are created which could break or bend the spike.

The lawn sprinkler securing apparatus may include a web attached to and extending diagonally from the hollow coupling to the spike shaft. The web may also be attached to a lower edge of the offset. The web gives both structural stability and rigidity to the lawn sprinkler securing apparatus. Additionally, the web acts as an anti-rotation device such that the lawn sprinkler securing apparatus does not rotate in the direction of the rotation of the sprinkler head. However, it is understood that any known anti-rotation device, such as a thin, short spike extending downward from the hollow coupling or the offset can be used.

The lawn sprinkler securing apparatus can be made of any suitable, substantially rigid material, such as metal, plastic, wood, or the like.

Additionally, the spike head can also be configured to make it easier to press the spike into the lawn with the palm of the hand, or the foot. The spike head can be configured in any appropriate any shape, such as circular, triangular, square, rectangular, pentagonal, spherical, etc., or can be ergonomically designed to fit the hand.

The offset may also include a finger hole extending therethrough. The finger hole allows a person to place his or her finger through the finger hole when gripping the lawn sprinkler securing apparatus, thus giving the user a more secure grip when insert or removing the lawn sprinkler securing apparatus. The finger hole can be of any suitable diameter to accommodate the person's finger, preferably 1 inch in diameter. It is of course understood that a tool, such as a screwdriver, can be inserted through the finger hole for insertion or removal of the lawn sprinkler securing apparatus. The finger hole can, of course, be of a small diameter such that it only accommodates a tool for insertion or removal rather than the person's finger.

The lawn sprinkler securing apparatus may also be designed as separate components which can be detachably attached to one another. In a preferred embodiment, the spike shank has a shaped channel, extending along the length of the spike shank, for receiving and retaining a shaped extension attached to the sprinkler offset, the web, or both. The shaped channel and the shaped extension cross-section could be any suitable cross-sectional shape, such as T-shaped, triangular, square, rectangular, circular, oval, etc.

The separate component lawn sprinkler securing apparatus design may also have a shaped lock ring attached to the web for the insertion and mated engagement of the spike shaft. Preferably, the lock ring has a substantially similar cross-sectional shape to the spike shaft. The engagement of the spike shaft and the lock ring give stability and rigidity to the separate component lawn sprinkler securing apparatus. The separate component design minimizes cost by allowing convenient replacement of any component which becomes damaged or broken without having purchase an entire lawn sprinkler securing apparatus. Each component can be made of the same or different substantially rigid material. The use of different substantially rigid material minimizes cost by allowing less expensive material to be use on the components which receive less wear or stress when in use.

BRIEF DESCRIPTION OF THE DRAWINGS

While the specification concludes with claims particularly pointing out and distinctly claiming that which is regarded as the present invention, the objects and advantages of this invention can be more readily ascertained from the following description of the invention when read in conjunction with the accompanying drawings in which:

DETAILED DESCRIPTION OF THE INVENTION

Figure 1:
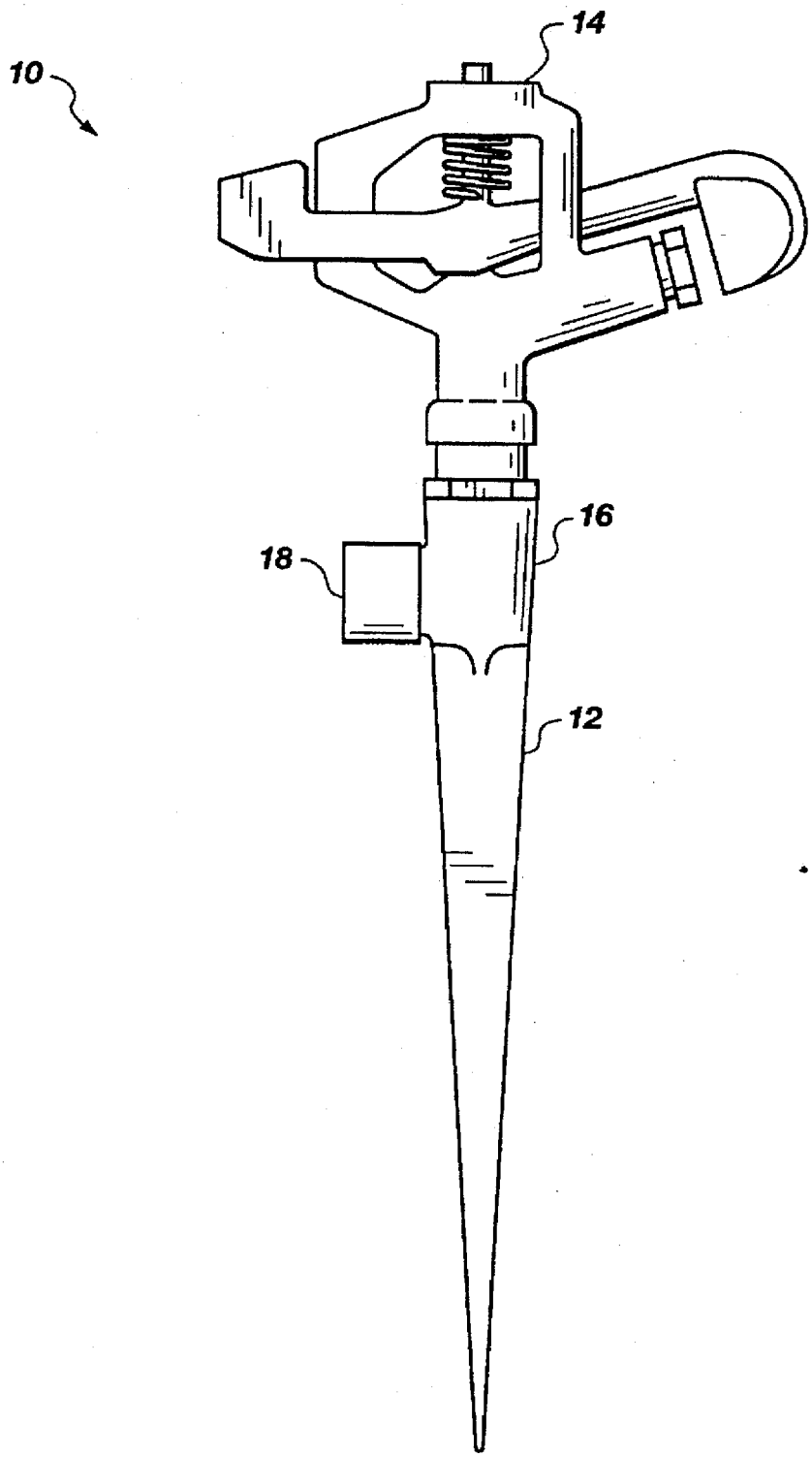
Fig. 1 (PRIOR ART)
FIG. 1 is a side plan view of a prior art apparatus for securing a lawn sprinkler.
Figure 2:
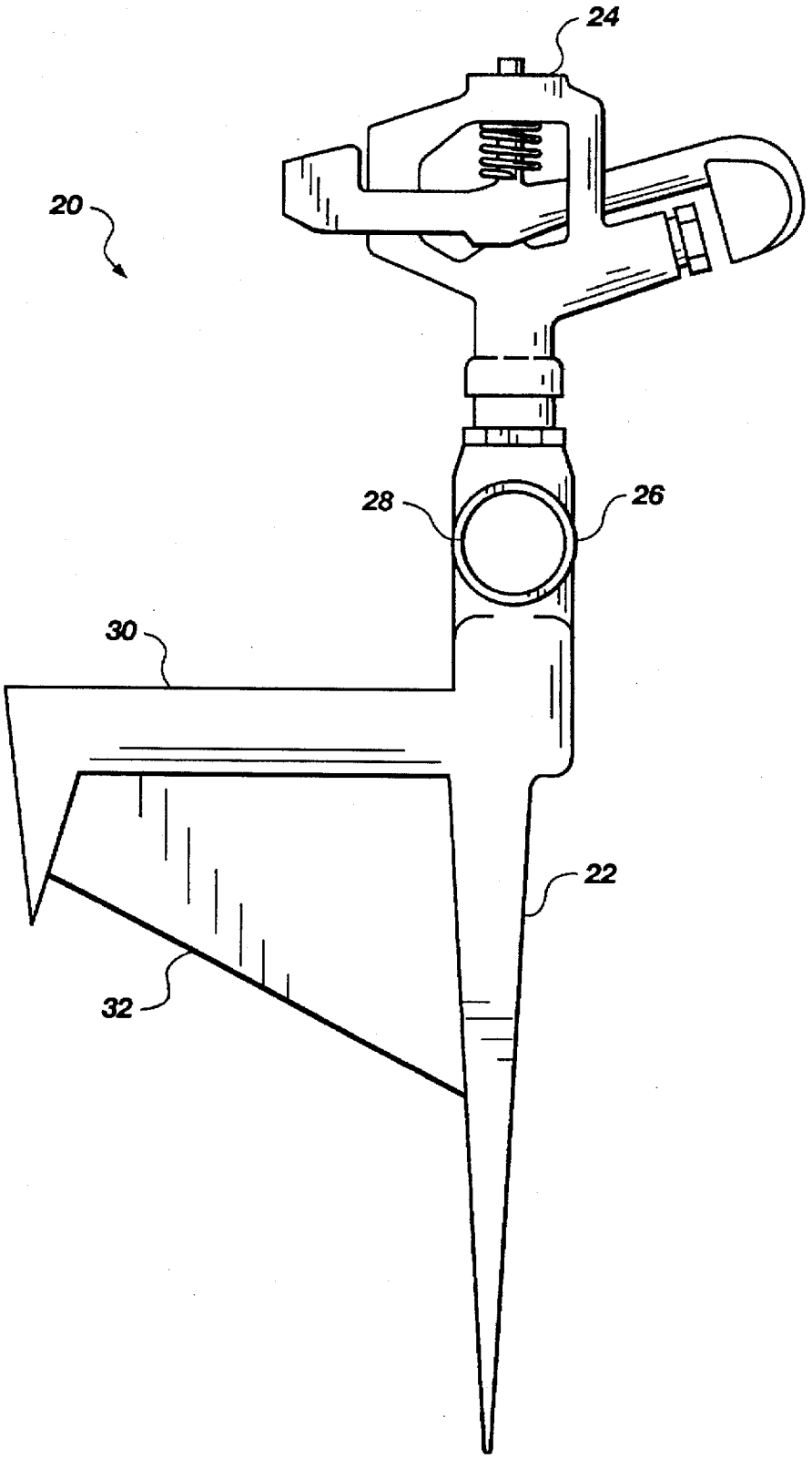
Fig. 2 (PRIOR ART)
FIG. 2 is a side plan view of another prior art apparatus for securing a lawn sprinkler.
Figure 3:
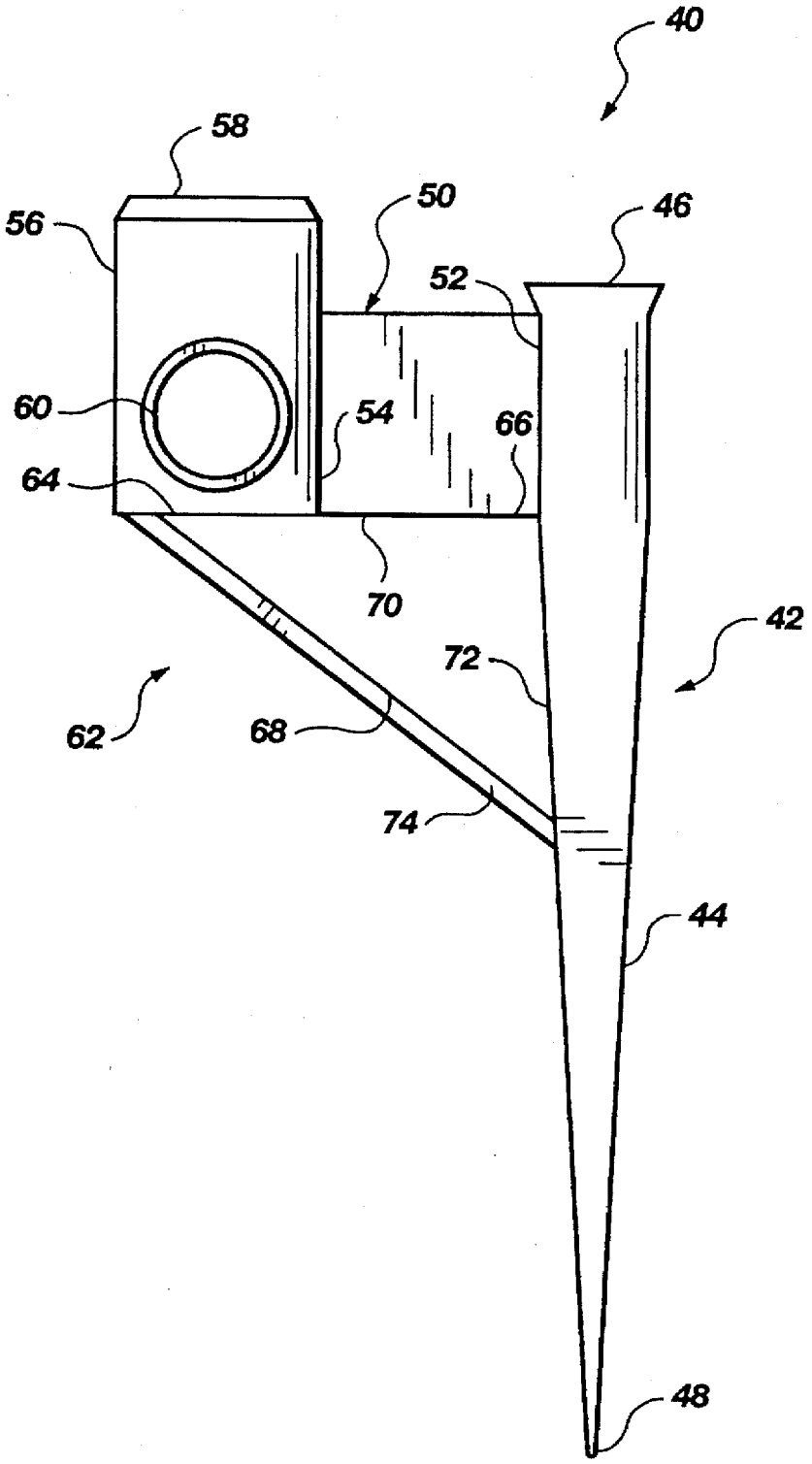
FIG. 3 is a side plan view of one embodiment of the present invention.

FIG. 3 illustrates a lawn sprinkler securing apparatus 40 having a spike 42 with a spike head 46 at one end of the spike 42 and an elongate spike shaft 44 which tapers from a position proximate the spike head 46 to a spike tip 48. The spike 42 is inserted into the ground (i.e. the lawn) spike tip 48 first by imparting a force on the spike head 46 (i.e. striking with a hammer, pushing by hand, stepping thereon, etc.) such that the spike head 46 faces upward. The spike 42 is preferably of a length such that about 6 inches of the elongate spike shaft 44 is inserted into the ground.

A sprinkler offset 50 is attached to the spike shaft 44 at a sprinkler offset first end 52 proximate the spike head 46 and extends substantially perpendicularly from the spike shaft 44. A hollow sprinkler coupling 56 is attached to the sprinkler offset 50 at a second end 54. The hollow sprinkler coupling 56 includes a sprinkler socket 58 which is capable of receiving a commercially available sprinkler head (not shown), wherein the sprinkler socket 58 is positioned to face substantially upward, as does the spike head 46, when the spike 42 is inserted into the ground. The sprinkler socket 58 may be threaded to receive an externally threaded sprinkler head, if desired. A key and slot arrangement may be employed to secure the inserted sprinkler head against backing out of the sprinkler socket 58. The hollow sprinkler coupling 56 also includes hose attachment means 60 which is normally a female fitting for receiving a standard garden hose, but which may also comprise a male fitting, a clamp, a quick disconnect fitting, or the like as known in the art. The hollow sprinkler coupling 56 further includes a sealed end 64 substantially opposite the sprinkler socket 58. Thus, the hollow sprinkler coupling 56 allows for fluid communication between the hose attachment means 60 and the sprinkler socket 56.

The hollow sprinkler coupling 56 may also include at least one other hose attachment means (not shown) such that a number of lawn sprinkler securing apparatus 40 can be linked in series by additional hoses.

The lawn sprinkler securing apparatus 40 may optionally include a web 62 attached at a first web edge 70 to the sealed end 64 and extending diagonally and attached along a second web edge 72 to the spike shaft 44. The web 62 may also be attached to a lower edge 66 of the sprinkler offset 50. The web 62 lends both structural stability and rigidity to the lawn sprinkler securing apparatus 40. Additionally, the web 62 acts as an anti-rotation device such that the lawn sprinkler securing apparatus 40 does not rotate in the direction of the rotation of the sprinkler head (not shown). However, it is understood that any known anti-rotation device, such as a thin, short spike extending downward from the sealed end 64 or the offset 50, can be used. The web 62 is preferably about ⅛ inch thick with a reinforcement 74, such as a lip which is preferably 3/16 inch thick, along a diagonal web edge 68 which extends diagonally from the sealed end 64 to the spike shaft 44.

The lawn sprinkler securing apparatus 40 can be made of any suitable, substantially rigid material, such as metal, plastic, wood, or the like.

Figure 4:
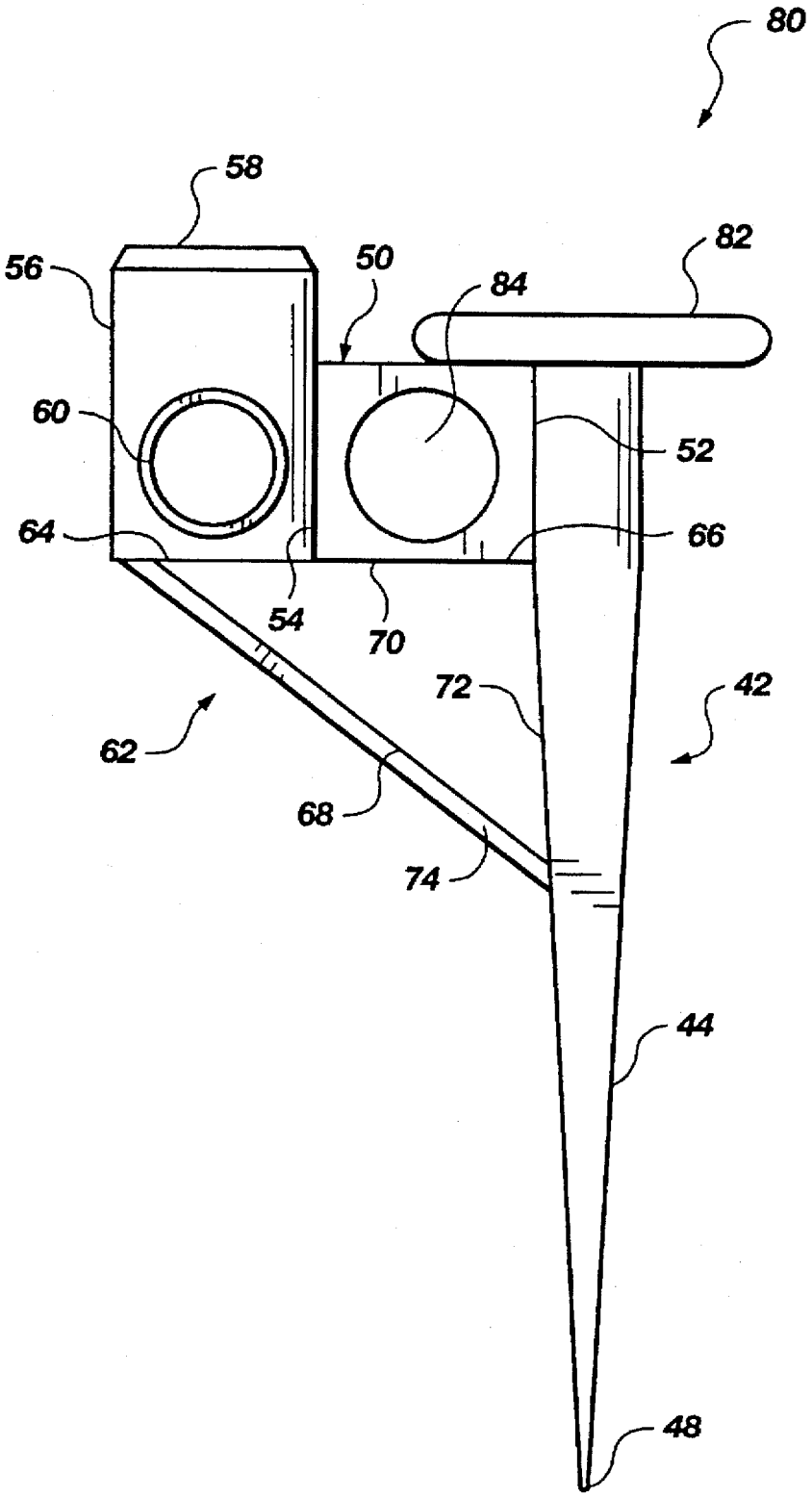
FIG. 4 is a side plan view of another embodiment of the present invention.

FIG. 4 illustrates an alternative embodiment of a lawn sprinkler securing apparatus 80. The basic structure of the lawn sprinkler securing apparatus 80 is similar to the lawn sprinkler securing apparatus 40 shown in FIG. 3, therefore the numbering for analogous structures remains the same. FIG. 4 illustrates an alternate spike head 82 configuration. The spike head 82 is a flat disk, preferably about 2.5 inches in diameter and about ⅜ inch thick. This configuration makes it easier to press the spike 42 into the lawn with the palm of the hand, or the foot. It is, of course, understood that the spike head 82 can be of any cross-sectional shape, such as triangular, square, rectangular, pentagonal, spherical, etc., or can be ergonomically designed to fit the hand.

FIG. 4 also illustrates the novel feature of a finger hole 84 extending through the sprinkler offset 50. The finger hole 84 allows a person to place his or her finger through the finger hole 84, thus giving a secure grip when inserting or removing the lawn sprinkler securing apparatus 80. The finger hole can be of any suitable diameter to accommodate the person's finger, preferably 1 inch in diameter. It is of course understood that a tool, such as a screwdriver, can be inserted through the finger hole 84 and used to insert or remove the lawn sprinkler securing apparatus 80. The finger hole 84 can be of a small diameter such that it only accommodates a tool for insertion or removal rather than the person's finger.

Figure 5:
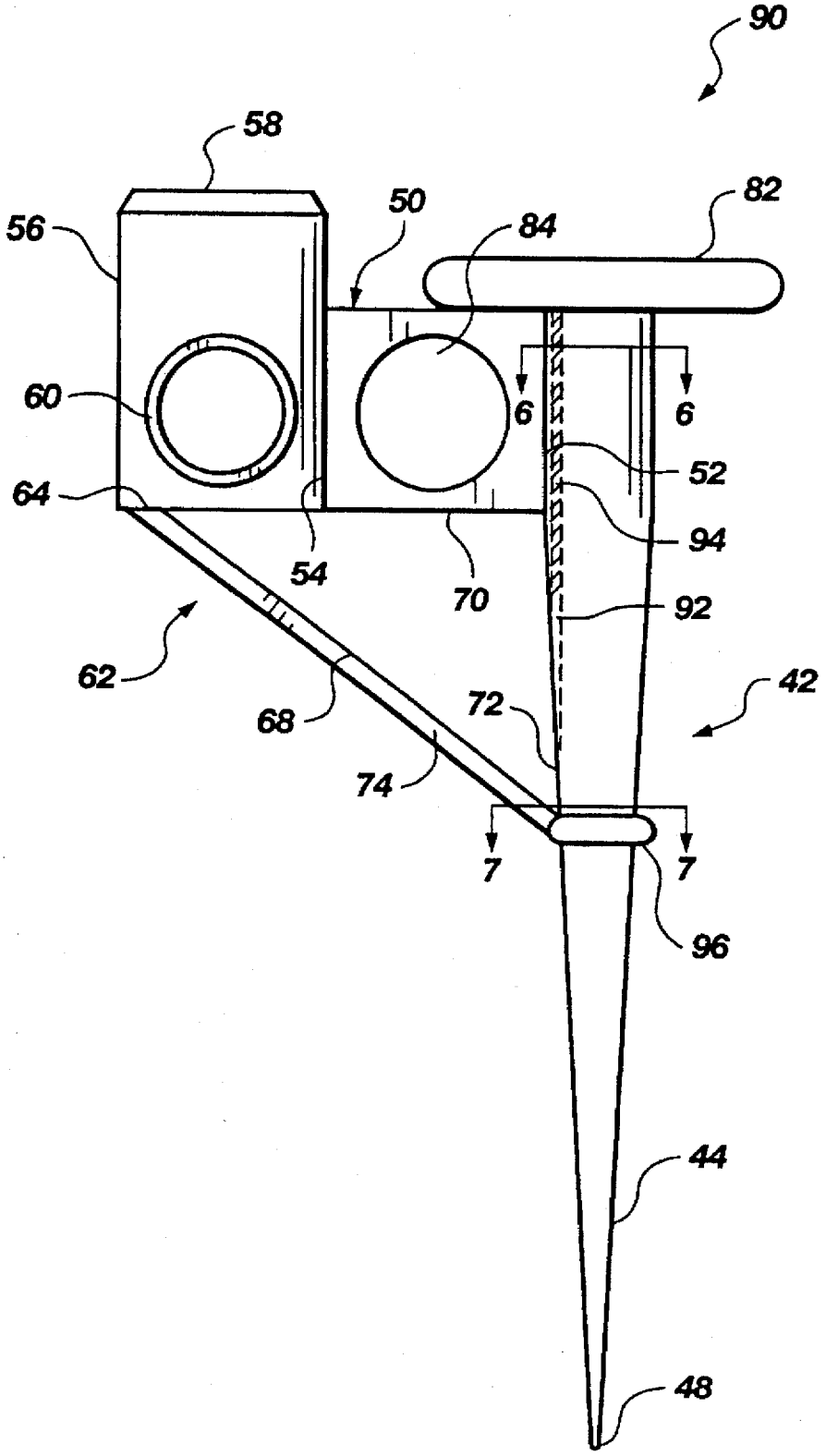
FIG. 5 is a side plan view of yet another embodiment of the present invention.
Figure 6:
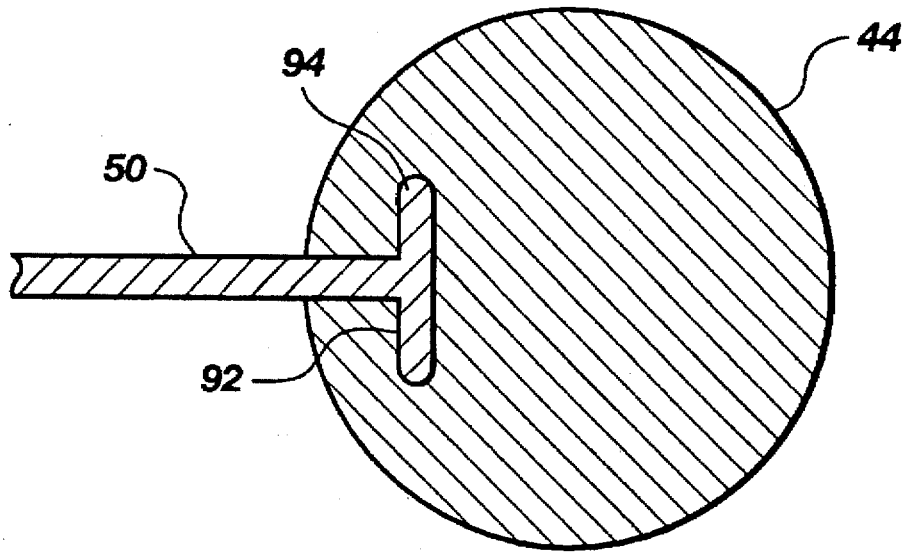
FIG. 6 is a cross-sectional view of a spike shank of the present invention shown in FIG. 5 along line 6—6.
Figure 7:
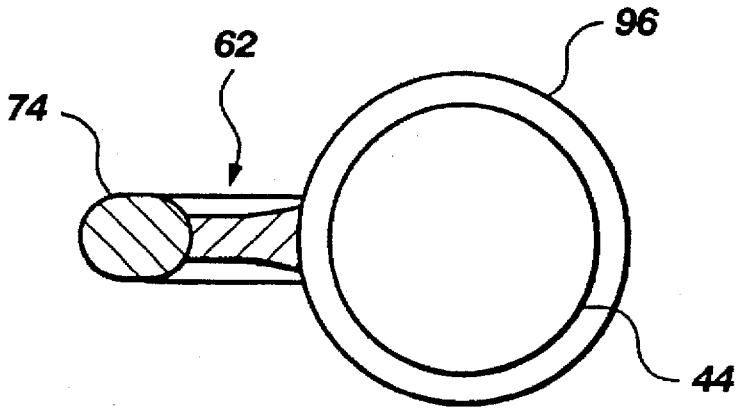
FIG. 7 is a cross-sectional view of a spike shank of the present invention shown in FIG. 5 along line 7—7.

FIGS. 5–7 illustrates yet another embodiment of a lawn sprinkler securing apparatus 90. The basic structure of the lawn sprinkler securing apparatus 90 is similar to the lawn sprinkler securing apparatus 80 shown in FIG. 4, therefore the numbering for analogous structures remains the same. FIG. 5 shows a two-piece lawn sprinkler securing apparatus 90 wherein the spike 42 is detachably attached to the remaining components of the lawn sprinkler securing apparatus 90. In a preferred embodiment, the spike shank 44 has a shaped channel 92, extending along a predetermined length of the spike shank 44, for receiving and retaining a shaped extension 94 attached to the sprinkler offset first end 52. FIG. 6 shows the shaped channel 92 and the shaped extension 94 cross-section as T-shaped. However, it is understood that the shaped channel 92 and the mating shaped extension 94 cross-section could be any suitable cross-sectional shape, such as triangular, square, rectangular, circular, oval, etc. FIG. 5 also shows that a portion of the shaped extension 94 is attached to a portion of the second web edge 72. This portion of extension 94 is also received and retained by the shaped channel 92. It is, of course, understood that the shaped extension 94 could be attached only to the sprinkler offset first end 52 or only to the second web edge 72.

Additionally, FIG. 6 shows the spike shaft 44 cross-section as circular. However it is, of course, understood that the spike shaft 44 could have any suitable cross-sectional shape, such as T-shaped, cross-shaped, triangular, square, rectangular, oval, etc.

FIGS. 5 and 7 shows an optional, appropriately shaped lock ring 96 attached to the web 62 along the second web edge 72 perpendicular to the axis of the spike shaft 44, preferably proximate the convergence of the second web edge 72 and the diagonal edge 68. The spike shaft 44 extends through and engages the lock ring 96. The spike shaft 44 and the lock ring 96 preferably have a substantially similar cross-sectional shape and open area shape, respectively, such that the spike shaft 44 and the lock ring 96 become matedly engaged. The engagement of the spike shaft 44 and the lock ring 96 give stability and rigidity to the two-piece lawn sprinkler securing apparatus 90.

The lawn sprinkler securing apparatus 90 can be made of any suitable, substantially rigid material, such as metal, plastic, wood, or the like. However, it is understood that each piece of the two-piece lawn sprinkler securing apparatus 90 shown in FIG. 5 could be made of the same or different substantially rigid material.

It is, of course, understood that the present invention is not limited to only one offset extending from the spike. Thus, a plurality of offsets could extend from the spike wherein each offset houses a separate sprinkler head. Additionally, the present invention could include a handle for removing the sprinkler from the ground.

The lawn sprinkler securing apparatus could comprise two opposing offsets extending from a single spike wherein each of the offsets has a hollow sprinkler coupling with a sprinkler head. The lawn sprinkler securing apparatus can be designed with a fluid conduit such that the hollow sprinkler couplings are in fluid communication, thus only one hose is required. The single spike could also have a spike head designed for a user to step down on the spike head with a handle extending up and over the spike head. The handle can either be rigidly attached and large enough for the insertion of the user's foot to step down on the spike head, or can be rotatably mounted such that it can be rotated to a position which does not interfere with the user's foot when stepping down on the spike head.

Having thus described in detail preferred embodiments of the present invention, it is to be understood that the invention defined by the appended claims is not to be limited by particular details set forth in the above description as many apparent variations thereof are possible without departing from the spirit or scope thereof.

What is claimed is:

1. A lawn sprinkler securing apparatus, comprising:

a spike having a spike head at one end and an elongate tapered spike shaft terminating in a spike tip;

at least one offset having a first end, a second end, and a lower edge, wherein said offset first end is attached to said spike shaft;

a sprinkler coupling attached to said offset second end, wherein said sprinkler coupling including a sprinkler attachment structure capable of engaging a sprinkler head;

hose attachment means attached to said sprinkler coupling for receiving a hose;

a passage for communicating fluid from said hose through said sprinkler coupling, and to said sprinkler head; and rotation prevention means for preventing the rotation of said spike, said rotation prevention means comprising a web having a first web edge, a second web edge, and a diagonal web edge; said web first edge is attached to said sprinkler coupling and said web second edge is attached to said spike shaft.

2. The lawn sprinkler securing apparatus of claim 1, wherein said web first edge is attached to said offset lower edge.

3. The lawn sprinkler securing apparatus of claim 1, wherein said diagonal web edge is reinforced.

4. The lawn sprinkler securing apparatus of claim 1, wherein said spike head comprises a flat disk.

5. The lawn sprinkler securing apparatus of claim 1, wherein said offset includes a hole extending therethrough.

6. The lawn sprinkler securing apparatus of claim 5, wherein said hole is of a suitable diameter to accommodate a user's finger.

7. The lawn sprinkler securing apparatus of claim 5, wherein said hole is about 1 inch in diameter.

8. The lawn sprinkler securing apparatus of claim 1, wherein said offset first end is attached to said spike shaft proximate said spike head.

9. A lawn sprinkler securing apparatus, comprising:

a spike having a spike head and an elongate spike shaft which tapers to a spike tip;

at least one offset having a first end, a second end, and a lower edge, wherein said offset first end is detachably attached to said spike shaft;

a sprinkler coupling attached to said offset second end, said sprinkler coupling including a sprinkler attachment structure capable of engaging a sprinkler head;

hose attachment means attached to said sprinkler coupling for receiving a hose;

a passage for communicating fluid from said hose, through said sprinkler coupling, and to said sprinkler head; and said spike shaft includes a channel extending along a predetermined length thereof for receiving and retaining a like-shaped extension attached to said offset first and, and said offset including said like-shaped extension, said extension including a protrusion and said channel including an enlargement to accommodate said protrusion.

10. The lawn sprinkler securing apparatus of claim 9, wherein said protrusion forms a "T" with said extension and said enlargement forms a "T" with said channel.

11. The lawn sprinkler securing apparatus of claim 9, further comprising:

a web having a first web edge, a second web edge, and a diagonal web edge; said web first edge is attached to said hollow sprinkler coupling and said web second edge abuts said spike shaft.

12. The lawn sprinkler securing apparatus of claim 11, wherein said web first edge is attached to said offset lower edge.

13. The lawn sprinkler securing apparatus of claim 11, further including a lock ring attached to said web second edge receiving said spike shaft therethrough.

14. The lawn sprinkler securing apparatus of claim 13, wherein said lock ring is located proximate the convergence of said second web edge and said diagonal edge.

15. The lawn sprinkler securing apparatus of claim 13, said spike shaft and said lock ring preferably have a substantially similar cross-sectional shape such that the spike shaft and the lock ring become matedly engaged.

16. The lawn sprinkler securing apparatus of claim 11, wherein said diagonal web edge is reinforced.

17. The lawn sprinkler securing apparatus of claim 9, wherein said spike head comprises a flat disk.

18. The lawn sprinkler securing apparatus of claim 9, wherein said offset includes a hole extending therethrough.

19. The lawn sprinkler securing apparatus of claim 18, wherein said hole is of a suitable diameter to accommodate a user's finger.

20. The lawn sprinkler securing apparatus of claim 18, wherein said hole is about 1 inch in diameter.

21. The lawn sprinkler securing apparatus of claim 9, wherein said offset first end is detachably attached to said spike shaft proximate said spike head.

22. The lawn sprinkler securing apparatus of claim 9, further including a lock ring attached to said offset second edge receiving said spike shaft therethrough.

23. The lawn sprinkler securing apparatus of claim 22, said spike shaft and said lock ring preferably have a substantially similar cross-sectional shape such that the spike shaft and the lock ring become matedly engaged.

24. A lawn sprinkler securing apparatus, comprising:

a spike having a spike head and an elongated spike shaft which tapers to a spike tip;

at least one offset having a first end, a second end, and a lower edge, wherein said offset first end is detachably attached to said spike shaft;

a sprinkler coupling attached to said offset second end, said sprinkler coupling including a sprinkler attachment structure capable of engaging a sprinkler head;

hose attachment means attached to said sprinkler coupling for receiving a hose;

a passage for communicating fluid from said hose, through said sprinkler coupling, and to said sprinkler head; and said spike shaft includes a channel extending along a predetermined length of said spike shaft for receiving and retaining a like-shaped extension attached to said offset second end.

25. The lawn sprinkler securing apparatus of claim 24, further comprising:

a web having a first web edge, a second web edge, and a diagonal web edge; said web first edge is attached to said hollow sprinkler coupling and said web second edge abuts said spike shaft.

26. The lawn sprinkler securing apparatus of claim 25, wherein said web first edge is attached to said offset lower edge.

27. The lawn sprinkler securing apparatus of claim 25, further including a lock ring attached to said web second edge receiving said spike shaft therethrough.

28. The lawn sprinkler securing apparatus of claim 27, wherein said lock ring is located proximate the convergence of said second web edge and said diagonal edge.

29. The lawn sprinkler securing apparatus of claim 27, said spike shaft and said lock ring preferably have a substantially similar cross-sectional shape such that the spike shaft and the lock ring become matedly engaged.

30. The lawn sprinkler securing apparatus of claim 25, wherein said diagonal web edge is reinforced.

31. The lawn sprinkler securing apparatus of claim 24, wherein said spike head comprises a flat disk.

32. The lawn sprinkler securing apparatus of claim 24, wherein said offset includes a hole extending therethrough.

33. The lawn sprinkler securing apparatus of claim 32, wherein said hole is of a suitable diameter to accommodate a user's finger.

34. The lawn sprinkler securing apparatus of claim 32, wherein said hole is about 1 inch in diameter.

35. The lawn sprinkler securing apparatus of claim 34, further including a lock ring attached to said offset second edge receiving said spike shaft therethrough.

36. The lawn sprinkler securing apparatus of claim 35, said spike shaft and said lock ring preferably have a substantially similar cross-sectional shape such that the spike shaft and the lock ring become matedly engaged.

37. The lawn sprinkler securing apparatus of claim 24, wherein said offfset first end is detachably attached to said spike shaft proximate said spike head.

* * * * *

UNITED STATES PATENT AND TRADEMARK OFFICE

CERTIFICATE OF CORRECTION

PATENT NO. : 5,687,909

DATED : November 18, 1997

INVENTOR(S) : Dean

It is certified that error appears in the above-identified patent and that said Letters Patent is hereby corrected as shown below:

In column 1, line 27, change "mount" to --amount--

In column 2, line 29, change "apply" to --applied--

In column 2, line 49, delete "any" (second occurrence)

In column 2, line 56, change "insert" to --inserting--

In column 3, line 17, after "having" insert --to--

In column 3, line 21, change "use" to --used--

In column 4, line 15, change "56" to --58--

In column 4, line 66, change "illustrates" to --illustrate

In column 5, line 28, change "shows" to --show--

In column 6, line 61, change "and" (first occurrence) to --end--

In column 8, line 41, change "claim 34" to --claim 24--

Signed and Sealed this

Twelfth Day of January, 1999

*Attest:*

*Attesting Officer*

*Acting Commissioner of Patents and Trademarks*